US005456469A

United States Patent [19]

MacDougall

[11] Patent Number: 5,456,469

[45] Date of Patent: Oct. 10, 1995

[54] DYNAMICALLY STABILIZED GOLF CLUB

[76] Inventor: Alexander S. MacDougall, 495 Valley Club Rd., Santa Barbara, Calif. 93108

[21] Appl. No.: 375,801

[22] Filed: Jan. 17, 1995

[51] Int. Cl.[6] ..... A63B 53/04

[52] U.S. Cl. ..... 273/174; 273/167 H; 273/167 A; 273/175

[58] Field of Search ..... 273/167 R, 168, 273/78, 169, 170, 171, 172, 173, 174, 175, 167 A, 167 B, 167 C, 167 D, 167 E, 167 F, 167 G, 167 H, 167 J, 167 K, 77 R, 77 A, 194 R, 187.4, 164.1, 186.2; D21/214, 215

[56] References Cited

U.S. PATENT DOCUMENTS

| | | | |
|---|---|---|---|
| D. 355,686 | 2/1995 | Hlinka | D21/214 |
| 1,531,821 | 3/1925 | Scott | 273/167 A |
| 1,532,545 | 4/1925 | Pedersen | 273/175 |
| 1,619,566 | 3/1927 | Crankshaw | 273/174 |
| 2,023,885 | 12/1935 | Hinckley | 273/175 |
| 2,301,369 | 11/1942 | Carvill . | |
| 2,550,846 | 5/1951 | Milligan . | |
| 3,068,011 | 12/1962 | Sano | 273/174 |
| 3,761,095 | 9/1973 | Thompson . | |
| 3,815,921 | 6/1974 | Turner . | |
| 3,997,170 | 12/1976 | Goldberg . | |
| 4,043,563 | 8/1977 | Churchward . | |
| 4,332,388 | 6/1982 | Crow . | |
| 4,471,961 | 9/1984 | Masghati et al. . | |
| 4,489,945 | 12/1984 | Kobayashi . | |
| 4,795,159 | 1/1989 | Nagamoto . | |
| 5,013,041 | 5/1991 | Sun et al. . | |
| 5,050,879 | 9/1991 | Sun et al. . | |
| 5,125,662 | 6/1992 | Antonious . | |
| 5,154,423 | 10/1992 | Antonious | 273/167 A |
| 5,213,329 | 5/1993 | Okumoto et al. . | |
| 5,240,252 | 8/1993 | Schmidt et al. . | |
| 5,314,185 | 5/1994 | Gorman | 273/167 A |

FOREIGN PATENT DOCUMENTS

| | | | |
|---|---|---|---|
| 0006733 | 1/1980 | European Pat. Off. . | |
| 0005407A1 | 5/1993 | European Pat. Off. . | |
| 405049715A | 3/1993 | Japan . | |
| 441593 | 1/1936 | United Kingdom | 273/174 |
| 2048693 | 12/1980 | United Kingdom . | |
| 2126906 | 4/1994 | United Kingdom . | |

OTHER PUBLICATIONS

John W. Baymiller, "Straighter Shots From Curved Clubfaces," Golf Digest, 1965, 5 pages.

*Primary Examiner*—Sebastiano Passaniti
*Attorney, Agent, or Firm*—Marvin E. Jacobs

[57] ABSTRACT

A golf club, suitable as a driver or a wood, with a pair of elongated strakes on the bottom that extend back from the ball impacting surface in a converging pattern from locations astride the sweet spot so as to act as skid runners and also dynamically stabilize the sweet spot, reduce the gear effect, and generate longer and more accurate shots.

9 Claims, 1 Drawing Sheet

DYNAMICALLY STABILIZED GOLF CLUB

TECHNICAL FIELD

This invention relates to the sport of golf, and more specifically golf club heads that are designed to yield more consistent, accurate, and predictable performance.

BACKGROUND OF THE INVENTION

When a golf club head strikes a golf ball slightly off center, that is, not directly in line with the center of gravity of the head, a spin is induced in the ball causing the ball to curve in flight. This effect is known as the gear effect and is thoroughly explored in U.S. Pat. No. 4,471,961 to Masghati et al. In essence, the off center impact of the ball causes the head to rotate about its center of gravity and this rotation, or spin, is transferred into the golf ball, like two gears meshing, so that the ball spins in the opposite direction. Spinning balls curve as they fly through the air.

In order to compensate for this adverse spin, golf club heads have convex curved impact surfaces, known as bulge, that intentionally deflect the ball sideways by increasing amounts for progressively further off center hits so that the inevitable curve will bring the ball roughly back to the desired path in line with the direction of the club swing. This compensation is approximate at best, and many prior art solutions have been attempted to minimize the gear effect.

The Masghati et al patent, for example, proposes weights in the head at locations far from the rotational axis so as to maximize the rotational inertia and, thus, resist head rotation. But trying to diminish head rotation in this manner is inherently limited because head weights are established at about 200 grams and even if nearly all of this weight is near the edge, the head will still twist in response to off center ball strikes.

Another problem in maintaining accuracy with convex impact surfaces is that all materials have some degree of elasticity. Hence, no matter what material a golf club head is made from, it will elastically deform from the impact of the ball so that the actual shape of the bulge is never fully predictable. It follows that the intentional misdirection of the ball, to compensate for spin, is also somewhat unpredictable. This temporary shape change may also affect the efficiency of the spin transfer to the ball, and, consequently, the magnitude of the gear effect. Modern club heads are typically constructed from a thin metal shell that is filled with a fairly stiff plastic foam. This produces a very durable, and very strong, head with a naturally high rotational moment of inertia. However, the head is still a highly dynamically flexible object which must necessarily yield and bend a bit upon impact. If it did not yield, that is, was very hard, it would be, by definition, brittle and would likely shatter on impact.

The discussion above concerns the technology surrounding the very long driving of balls and thus pertains more to drivers and the first shot off a well prepared tee. Once on the fairway, other problems arise as well, although distance may still be required. In this situation, golfers often switch from a driver to a so called wood, which may, in modern practice, be made from metal, wood, or plastics. To facilitate use of the club in taller grass, or in the rough, another class of prior art designs has emerged that use skids or strakes on the bottom surface, or sole, of the club head. These skids slide over or through the ground and keep the bulk of the bottom surface of the head from digging into the ground and grass and, thus, losing momentum. Typical prior art in this class is found in U.S. Pat. Nos. 4,332,388 to Crow, 5,213,329 to Okumoto et al, 5,125,662 to Antonious, 3,761,095 to Thompson, and 3,815,921 to Turner. All of these patents show various kinds of skids or runners on the bottom of the head intended to help the head track smoothly and more easily over the surface of the ground. All of these patents also require that the skids be parallel to the direction of movement of the head or swing. Crow, for example, says in column 3, line 32, that his parallel runners stabilize and track the head when it contacts the ground. Okumoto states that his skids extend in a back and forth direction relative to the direction of swing of the club. Antonious says in column 2, line 6, that his skid members have their longitudinal axis extending in the front to rear direction so as to furrow into the ground and prevent lateral club head movement (column 2, line 53). Thomson recites in column 2, that his so called keel 30 extends along a line that will be the path of swing of the head. Finally, Turner says that his keel is normal to the striking face in column 1, line 36. Clearly, it is the firm opinion in the art that strakes on the club head must be parallel to the swing path to avoid sideways deflections of the club upon ground contact. The present invention contemplates a complete reversal of this orthodoxy in order to achieve not only the benefits of skids, but also the taming of the gear effect, as explained below.

STATEMENT OF THE INVENTION

Briefly, this invention utilizes skids or strakes on the bottom of the club head that are not parallel to the swing direction, or to each other, but rather converge as they extend back from the bulge toward the rear of the head. It has been discovered that this arrangement provides numerous unexpected advantages. Firstly, no lateral deflections are induced by ground contact since each of the dual strakes are angled in opposite directions from the swing path and, therefore, cancel each other out. However, the strakes still keep the head from the digging into the ground and losing momentum. Secondly, the strakes brace the bulge at critical locations along its length near the ends of the effective strike zone and carry the impact forces back toward the center of gravity of the head. Thus, the bulge is more rigid, where it counts, so that the gear effect compensation is less affected by dynamic flexing and, accordingly, more consistent and predictable. In time, a golfer using this head can learn to be more accurate because the club head does the same thing every time, rather than dynamically bending and changing behavior for different force ball impacts. The head of the present invention is dynamically stabilized and generates more consistent, predictable, and repeatable performance.

The rigidized bulge rebounds faster, and propels the ball away more quickly for off center hits, because it is reinforced by the strakes at the off center locations. Hence, the ball spends less time in contact with the head. There is less time for spin transfer and therefore less gear effect. Since less spin is induced, less energy is absorbed by spin, leaving more energy to drive the ball further, a necessary consequence of the principle of conservation of energy.

The strakes are fairly massive compared to the thin shell of the head and, thus, add weight at a low location and at a forward location. The low location weight increases inertia and driving power. The forward location weight moves the center of gravity of the head forward, nearer the bulge. The gear effect rotates the head about the center of gravity. But since this center is now closer to the bulge, at a lesser radius, the sideways movement of the bulge is lessened, decreasing the gear effect.

As a result of all these above advantages, a club head is provided that is both a good driver and a good wood. The golfer can use the same club for both purposes which enhances learning and skill. Having to change clubs often makes it harder to become consistent and repeatable, harder to get in the groove, as the saying goes. Additional advantages and benefits will become apparent in the following detailed description and the drawings referenced thereby.

BRIEF DESCRIPTION OF THE DRAWINGS

FIG. 1 is a side elevational view of the golf club head of the present invention as seen from the ball impacting, or bulge, face side, showing the bottom strakes extending back from the bulge, the strakes visible, more or less, end on;

DETAILED DESCRIPTION OF THE INVENTION

Figure 1:
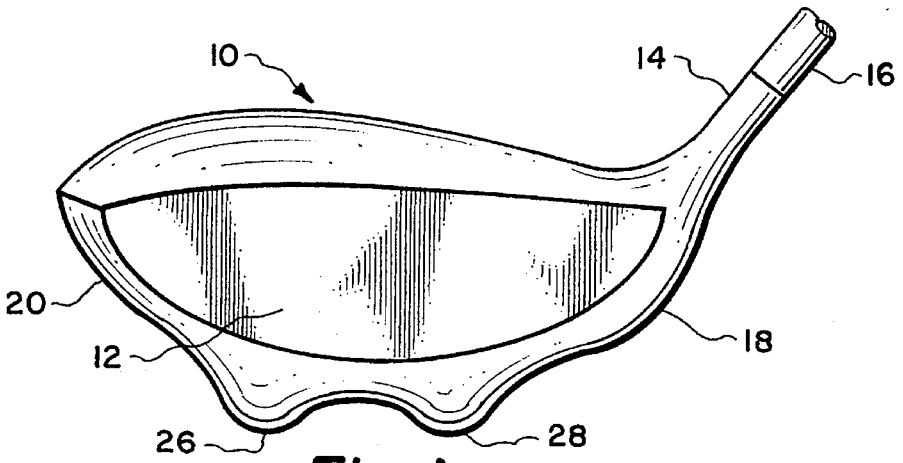
Figure 2:
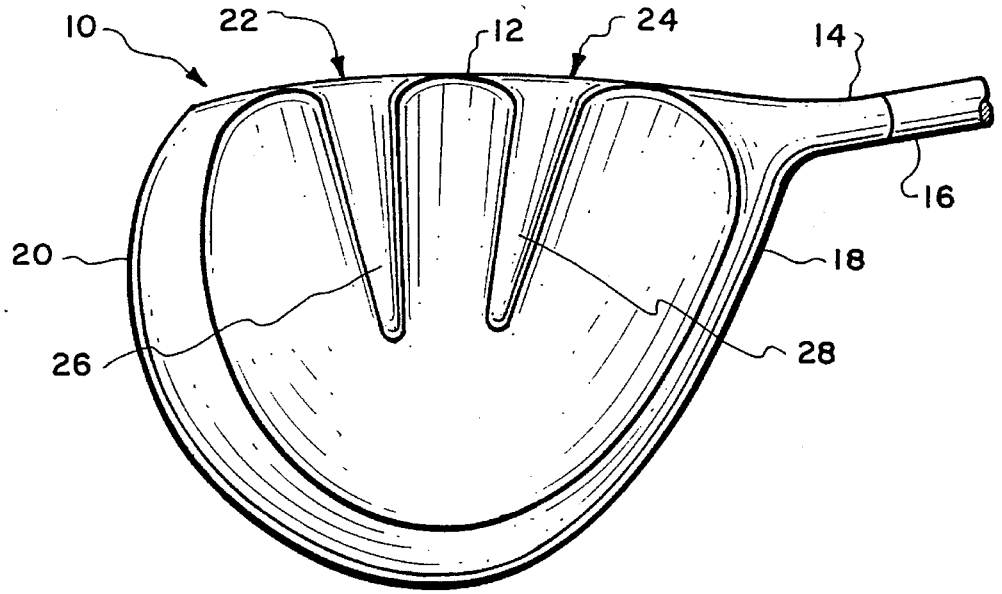
FIG. 2 is a bottom view of the head showing how the strakes begin at the bulge and extend back toward the rear, converging generally toward the center of the head and diminishing in size toward the rear so as to move the center of gravity forward toward the bulge.

FIGS. 1 and 2 show the inventive golf club head 10 with an impact surface or bulge 12 and a hosel 14 connected to a shaft 16. The radius of bulge 12 is typically about ten inches. The bulge is the curve over the left to right distance in FIG. 2 and is designed to compensate for the gear effect induced ball spin that curves the ball left and right when struck off center, either toward the heel 18, or the toe 20. Heads also have a curve in the impact surface 12 that is orthogonal to the bulge and referred to as the roll. The roll compensates for high and low strikes in the same manner as the bulge offsets left and right strikes, although the effect is less in terms of accuracy.

There are limits to the width of the effective contact zone, sometimes called a sweet spot, which are represented, for the purpose of the drawing, with numerals 22 and 24 which identify the approximate boundaries of the effective contact zone.

Two strakes 26 and 28 extend back from the bulge, from locations approximately near the boundaries 22 and 24 of the sweet spot, converging toward the center of the head and toward its center of gravity. Strakes 26 and 28 comprises elongated projections or bumps that serve as skids or runners to facilitate head motion in grass or in the rough. However, they decrease in size as they extend rearward so as to keep the preponderance of the mass forward near the bulge and relocate the center of gravity forward which decreases the gear effect. The strakes also lower the center of gravity, generally considered to add distance and power to the ball strike.

The strakes 26 and 28 are not necessarily in line with the swing path, or parallel to each other, as in the prior art. But since they diverge from the swing path in opposite directions, any lateral deflections caused by the strakes digging into the ground are cancelled out and do not generate directional errors.

Figure 3:
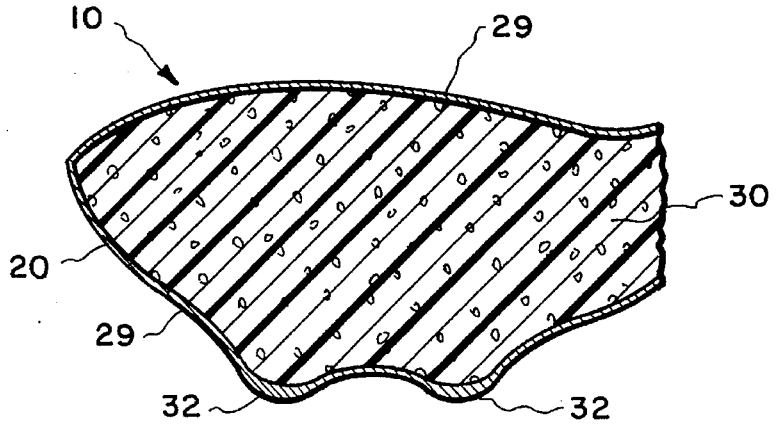
FIG. 3 is a fragmentary sectional view of the club head, oriented as in FIG. 1, showing that the head comprises a thin metal shell filled with a reinforcing plastic foam.

As may be seen in FIG. 3, head 10 comprises a very thin stainless steel metal shell 29 filled with a suitable reinforcing plastic foam 30. The strakes 26 and 28 may be made from a thicker metal, as shown at 32, if desired, so as to have a greater mass and strength. The foam filled shell is dynamically quite flexible, which makes it strong and tough under impact. But ball impacts that are off center also encounter very complex deflections that vary as a function of location, force, and other environmental conditions. These deflections produce hard to predict, variable, inconsistent compensations to the gear effect that make it harder for a golfer to learn the behavior of the club head. The strakes of the present invention significantly reduce these variables by rigidizing the bulge 12 at the approximate boundaries 22 and 24 of the sweet spot.

Strakes 26 and 28 capture and resist most of the ball impact force and convey it back toward the center of gravity. Since the strakes are positioned generally perpendicular to the ends 22 and 24 of the effective contact zone, they are very stiff and strong. Other parts of the bulge yield more easily and, thus, retreat from the ball impact, leaving the strakes to absorb the brunt of the force. Thus, the force is directed along the length of the strakes and into the center of gravity of the head. The shape of the bulge is better preserved, and the compensation for the gear effect is more consistent.

The more rigid bulge at the edges of the sweet spot rebound the ball quicker so that spin transfer is reduced and more energy is transferred as momentum. The gear effect is reduced as a result of the reduced spin transfer.

The present invention provides a club head with more power, more accuracy, more consistency, and less gear effect. This has been confirmed by many users who have tried the club and report a better feel, straighter shots, more distance, and less variability. The head permits use as both a driver and a wood so that the need to change clubs and relearn the correct swing is lessened. The principles of the invention, and the converging bottom strakes, are equally applicable to any type of club head, or head construction method. We intend, therefore, that the invention be limited only in accordance with the appended claims and their equivalents.

I claim:

1. A golf club head having a ball impact bulge face having an effective contact zone thereon defined by opposite ends and having a bulge face edge adjacent a bottom surface of said club head and said bottom surface having elongated strakes thereon extending back from the bulge face edge, said strakes converging toward each other as they extend away from the bulge face bulge, whereby said strakes serve to both reduce the lateral deflection of said club head upon contact thereof with the ground and brace the bulge face adjacent the ends of the effective contact zone.

2. The head of claim 1 in which there are two of said strakes.

3. The head of claim 1 in which said strakes diminish in size as they extend back from the bulge face edge.

4. The head of claim 1 in which said strakes converge generally toward the center of gravity of the head.

5. The head of claim 1 in which the strakes extend back from the bulge face edge from locations near the ends of the effective contact zone.

6. The head of claim 1 in which the head comprises a thin metal shell filled with a reinforcing plastic foam.

7. The head of claim 2 in which the strakes diminish in size as they extend back from the bulge face edge.

8. The head of claim 7 in which the strakes extend back from locations approximately at the ends of the effective contact zone.

9. The head of claim 8 in which the head comprises a thin metal shell filled with reinforcing foam.

* * * * *